US007329146B2

(12) United States Patent
Yang et al.

(10) Patent No.: US 7,329,146 B2
(45) Date of Patent: Feb. 12, 2008

(54) SURFACE MOUNTED CARD CONNECTOR

(75) Inventors: Gong-Qing Yang, ShenZhen (CN); Chang-Shin Hsu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/645,432

(22) Filed: Dec. 26, 2006

(65) Prior Publication Data

US 2007/0149046 A1 Jun. 28, 2007

(30) Foreign Application Priority Data

Dec. 23, 2005 (CN) ..... 200520140220

(51) Int. Cl.
*H01R 13/60* (2006.01)

(52) U.S. Cl. ..... 439/570; 439/74; 439/630

(58) Field of Classification Search ..... 439/570, 439/74, 566, 562, 563, 574, 862, 630
See application file for complete search history.

(56) References Cited

U.S. PATENT DOCUMENTS 6,086,424 A 7/2000 Chang
6,254,429 B1 7/2001 Morita
6,478,590 B1 * 11/2002 Kuo ..... 439/159
6,942,154 B1 * 9/2005 Haga et al. ..... 235/486
6,951,470 B1 * 10/2005 Huang ..... 439/159
7,001,212 B1 * 2/2006 Juntwait ..... 439/566
7,112,075 B1 * 9/2006 Su ..... 439/159
2005/0239333 A1 * 10/2005 Watanabe et al. ..... 439/630
2005/0255734 A1 * 11/2005 Liu ..... 439/326
2006/0057893 A1 * 3/2006 Matsunaga ..... 439/630
2006/0116013 A1 * 6/2006 Ooya et al. ..... 439/159
2007/0161274 A1 * 7/2007 Tanaka et al. ..... 439/159

* cited by examiner

*Primary Examiner*—Renee Luebke
*Assistant Examiner*—Vanessa Girardi
(74) *Attorney, Agent, or Firm*—Wei Te Chung

(57) ABSTRACT

A card connector with an insulating housing comprising a plurality of passageways; a plurality of contacts received in the passageways of the housing; the housing further receives metal guiding arms, each guiding arm having legs which engage opposite sides of the housing where one of the legs provides for soldered adhesion of each guiding arm to a printed circuit board.

15 Claims, 4 Drawing Sheets

SURFACE MOUNTED CARD CONNECTOR

BACKGROUND OF THE INVENTION

1. Field of the Invention

The present invention is generally related to a card connector, and especially to a connector for connecting with a SIM (Subscriber Identity Module) card.

2. Description of Related Art

Conventional electrical SIM card connector is disclosed in U.S. Pat. No. 6,086,424. The connector includes a rectangular housing defining two sets of the three contact passages extending from two opposite sides of the housing toward a middle portion thereof, respectively. Six contacts are fixedly received in the corresponding contact passageways by interferentially engaging fitting portions of the contacts with the housing, wherein each fitting portion has a slit formed therein so that each fitting portion is compressed by the housing when it is inserted into the corresponding contact passageway.

However, The conventional connector is mounted on the PCB (Print Circuit Board) by soldered solder portions of the contacts on the board. The housing of the connector has not been mounted on the board. So the connector can not mounted on the PCB securely.

Hence, an improved card connector is highly desired to overcome the aforementioned disadvantages of the prior art.

SUMMARY OF THE INVENTION

Accordingly, an object of the present invention is to provide a SIM card connector which has secure and simple soldering structure for securing the connector on PCB.

To achieve the above object, a card connector comprises insulating housing comprising a plurality of passageways; a plurality of contacts received in the passageways of the housing; and metal ears received on the housing; wherein the metal ear has legs extends on an upper surface and a bottom surface of the housing respectively to engage the metal ear on the housing and one of the legs is used to solder the metal ear on a PCB.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Figure 1:
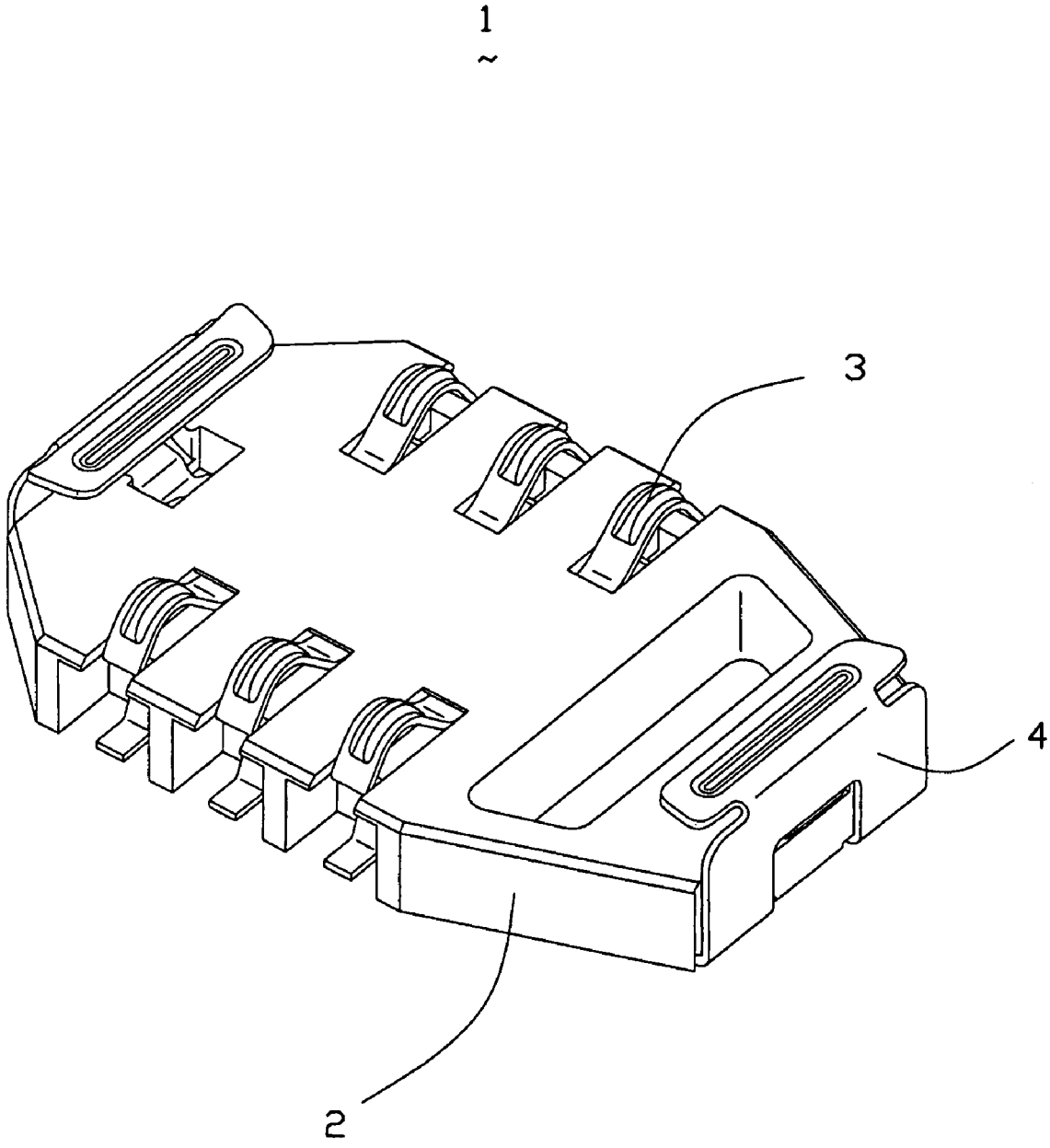
FIG. 1 is an assembled perspective view of the card connector in accordance with the present invention.
Figure 2:
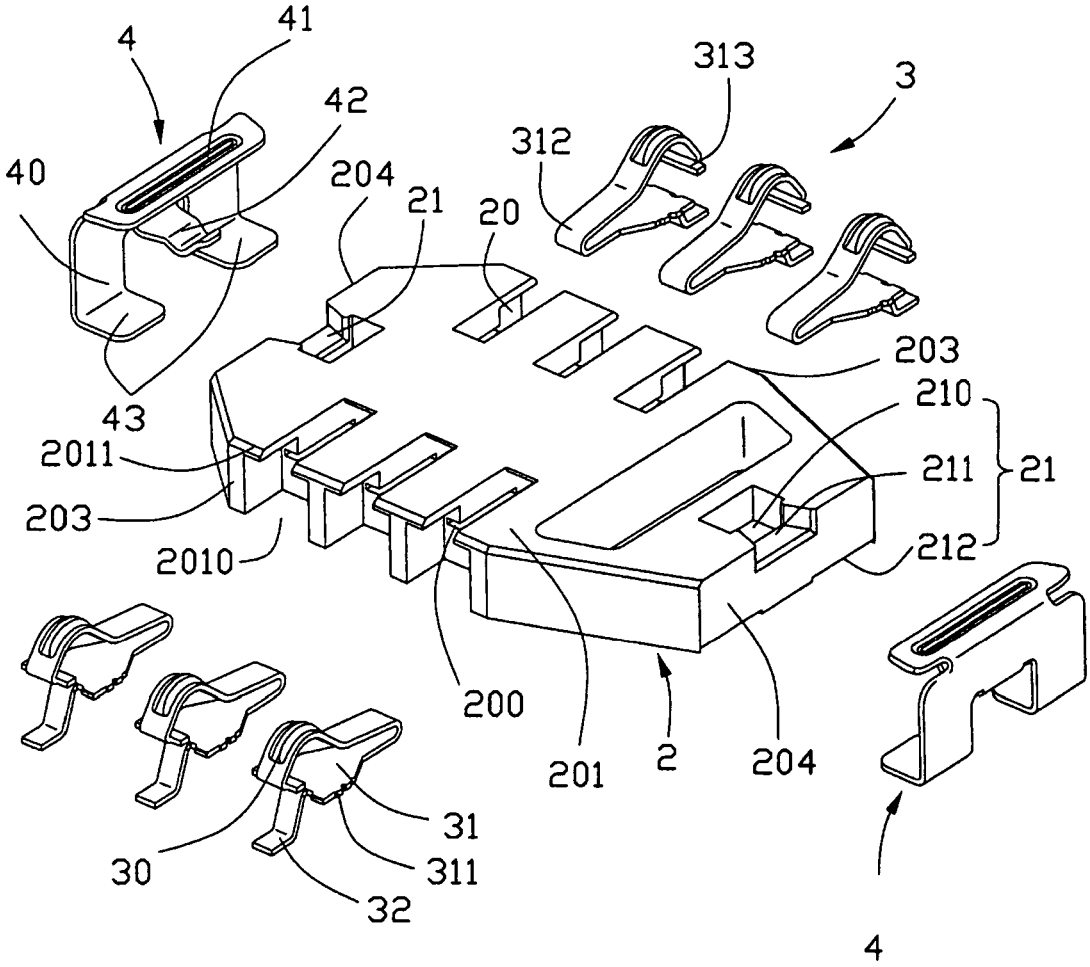
FIG. 2 is an exploded, perspective view of the card connector of FIG. 1.
Figure 3:
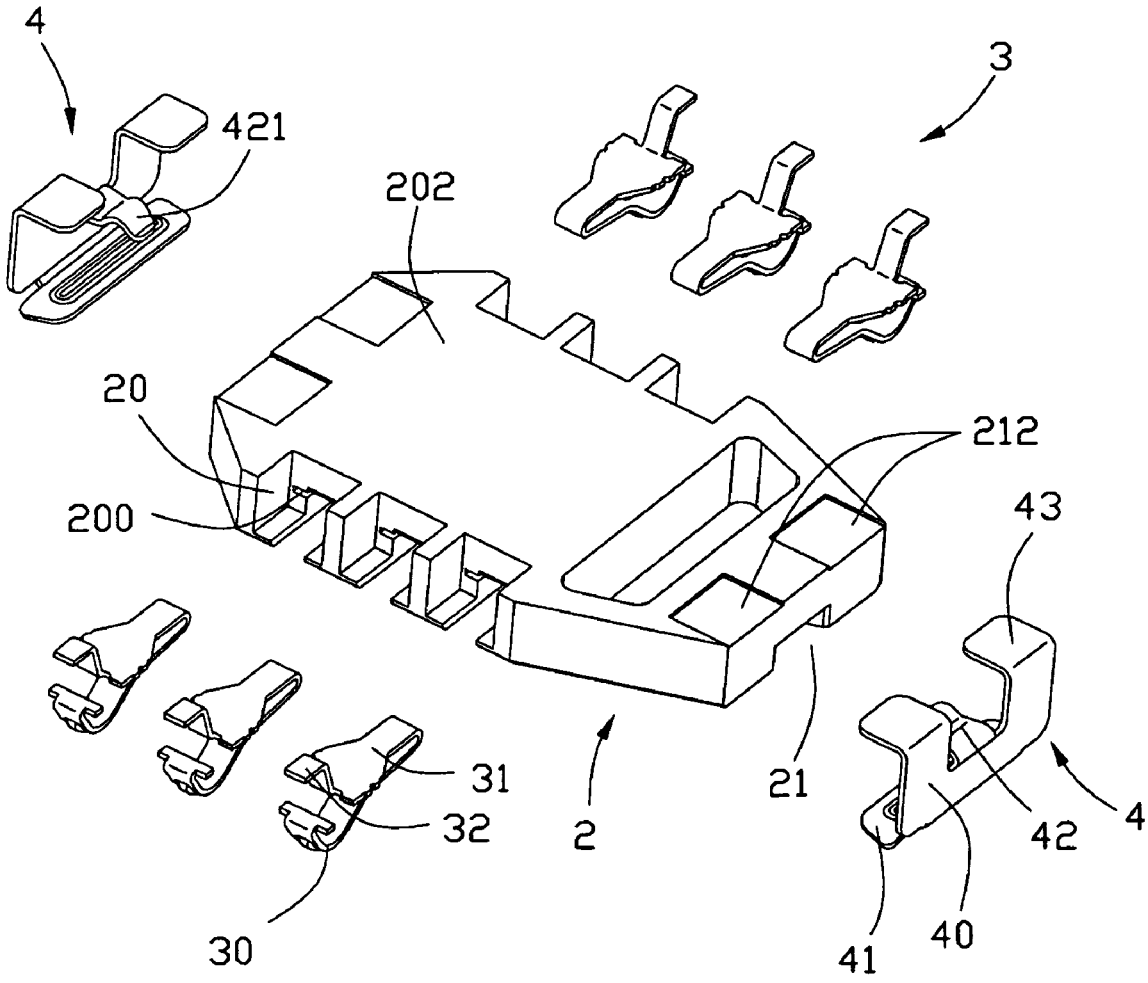
FIG. 3 is an exploded, perspective view of the card connector of FIG. 2, but from another aspect.
Figure 4:
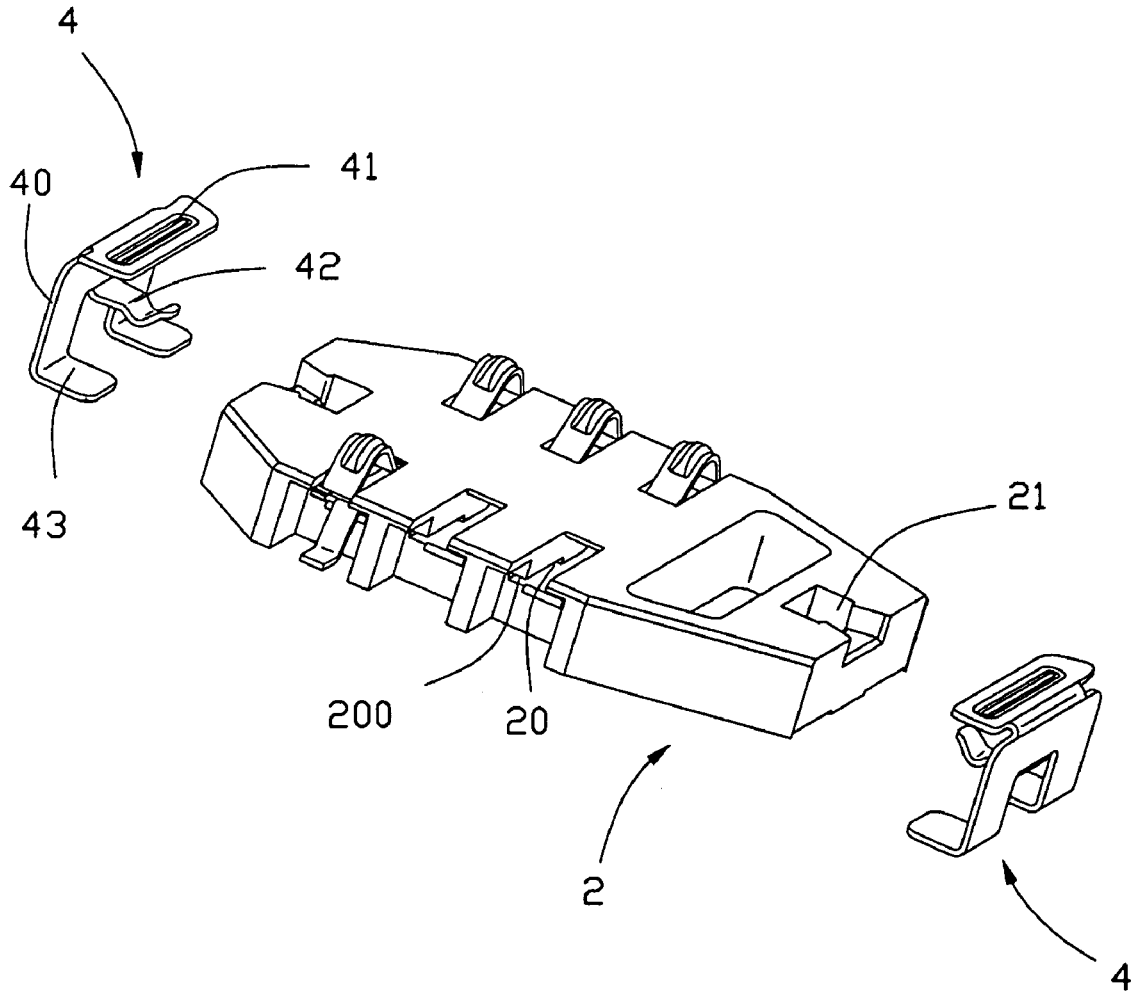
FIG. 4 is assembled perspective view of the card connector of FIG. 1, but the metal ear is not assembled.

Referring to FIGS. 1-3, a SIM card connector 1 in accordance with the present invention includes a shuttle-shaped housing 2, Two sets of three contacts 3 and a pair of metal ears 4. The housing 2 has a top surface 201 for proximity to a SIM card (not shown), a bottom surface 202 for proximity to a printed circuit board, two opposite longitudinal sides 203 and two opposite lateral sides 204 between the top and bottom surfaces 201, 202. Two sets of three contact passageways 20 are defined in the top surface 201 and extend from the two longitudinal sides 203 toward a middle portion of the housing 2, respectively. Each contact passageway 20 defines a depression portion 2010 which forms stops 2011 thereabove and a channel portion 200 therein.

The housing 2 further defines a pair of engaging portions 21 on two the lateral sides 204 of the housing 2 respectively. Each engaging portion 21 comprises an upper engaging portion formed on the top surface 201 and a bottom engaging portion 212 formed on the bottom surface 202, the upper engaging portion is formed in a middle of the lateral side 204 of the housing 2 and includes an outer recess 211 having flared inlet and an inner recess 210 having a bottom surface lower than the outer recess 211 to form a step between recesses 211, 210. The bottom engaging portion 212 is formed on the bottom surface 202 and is formed of a pair of recesses on two sides of the upper engaging portion.

Two sets of three contacts 3 are mounted into the corresponding contact passageways 20. Each contact 3 has a fitting portion 31 with barbs 311 on two longitudinal sides thereof. A soldering portion 32 extends below and rearward from the fitting portion 31 for mounted on a PCB (not show). An arced bridging section 312 extends in front of the corresponding fitting portion 31 to connect with a corresponding contact portion 30 for engaging with the SIM card (not shown). The contact portion 30 is located above the fitting portion 31 and is terminated at an enlarged free end 313 thereof.

The metal ear 4 comprises a vertical base portion 40, a top horizontal leg 41 extending from the base portion 40, a middle horizontal leg 42 and a pair of bottom horizontal legs 43 each extending from the base portion 40 corresponding to the engaging portion 21. The middle leg 42 has a curved portion 421 corresponding to the recess 210.

To assemble the connector 1, the two sets of contacts 3 are successively mounted into the contact passageways 20 by extending the fitting portions 31 into the corresponding channels 200 to reach a position in which the fitting portions 31 are located in the corresponding contact passageways 20 and compressed by the housing 2. The free ends 313 of the contact portions 30 are retained by the corresponding stops 2011 above the corresponding depression portions 2010 to obtain a preload therein. The contact portions 30 project beyond the top surface 201 of the housing 2. The metal ears 4 are mounted on two lateral sides of the housing 2, wherein the top leg 41 and bottom legs 43 are mounted on the top surface 201 and the bottom surface 202 respectively and the middle leg 42 is extended into the engaging portion 21 with the curved portion 421 extended in the inner recess 210 and received into the step. The base portion 40 is aligned with the side of the housing 2. The step formed between the inner and outer recesses 210, 211 prevents the metal ear from horizontal movement. And the top and the bottom legs are mounted on the surfaces of the housing to prevent the metal ear 4 from vertical movement.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector for mounted on a PCB (Print Circuit Board), comprising an insulating housing having an upper surface and a bottom surface further comprising a plurality of passageways;

a plurality of contacts received in the passageways of the housing; and the housing further comprising a recess formed on the upper surface;

the recess has an outer recess which has a flared inlet and an inner recess having a bottom surface lower than the outer recess with a step formed therebetween, at least two metal guiding arms received on the housing; wherein each metal guiding arm has a plurality of legs at least one of which extends across the upper surface and another across the bottom surface of the housing respectively, thus engaging the metal guiding arms onto the housing; wherein the leg portion, which extends across the upper surface of the housing, has a curved portion extending into the recess and secured by the step and one of the legs is used to solder each of the metal guiding arms onto a PCB.

2. The card connector as described in claim 1, wherein the contacts are mounted on two opposite longitudinal sides and metal ears are mounted on two opposite lateral sides of the housing respectively.

3. The card connector as described in claim 1, wherein legs mounted on the bottom surface is extended on recesses formed on the bottom surface of the housing.

4. The card connector as described in claim 1, wherein the metal ear further has a base portion aligned with the lateral side of the housing and the legs extend from the base portion.

5. The card connector as claimed in claim 1, wherein the whole housing extends in a planar manner.

6. The card connector as claimed in claim 1, further including complementary interengagement devices on both the guiding arms and lateral sides of the housing, which are configured and dimensioned such that the guiding arms are assembled onto the housing by horizontal and inward positioning with respect to the corresponding lateral sides of the housing.

7. The card connector as claimed in claim 1, wherein the lateral sides of the housing define recessed regions to receive complimentary portions of the corresponding guiding arms.

8. The card connector as claimed in claim 1, wherein said contacts defines a contact area on the upper surface of the housing, and the guiding arm is located outside of said contact area.

9. The card connector as claimed in claim 8, wherein the contact area extends along a front-to-back direction perpendicular to the lateral sides.

10. The card connector as claimed in claim 8, wherein the guiding arm comprises a vertical section which extends beyond the upper surface of the housing thus partially defining a card receiving space.

11. The card connector as claimed in claim 8, wherein the contact area occupies the lateral direction and in a front-to-back insertion direction of the upper surface of the housing, along which a card is inserted into or withdrawn from the card receiving space, wherein said lateral direction is larger than the insertion direction.

12. The card connector as claimed in claim 11, wherein each of the guiding arms are defined along the insertion direction and the lateral direction such that the portion of the guiding arm along the insertion direction is smaller than the portion of the guiding arm along the lateral direction thereby maintaining a compact arrangement of the guiding arms with regard to the housing.

13. The card connector as claimed in claim 1, wherein said contacts are arranged in two rows along the lateral direction, and the guiding arms are symmetrically arranged with regard to a center line between the two rows of contacts.

14. The card connector as claimed in claim 13, wherein the plurality of contacts within the two rows are arranged in a mirror image of one another.

15. A card connector comprising:

an insulative housing comprising an upper and lower face which defines a thickness such that the entire upper face of the housing occupies a uniform plane; wherein the housing further comprises opposite front and back sides defining a front-to-back direction as well as opposite lateral sides which are beveled such that where the lateral sides meet the front and back sides produces an angled side rather than a perpendicular corner; wherein the front and back sides share a first dimension and the opposite lateral sides share a second dimension, the second dimension being smaller than the first dimension; and a pair of metallic guiding arms assembled onto and securely fixed to the opposite lateral sides of the housing, the guiding arms each comprising a vertical section and a top flange; wherein the top flanges extending toward each other across the upper face of the housing yet do not come in contact with one another, and the vertical section originates at the lower face of the housing and extends the thickness of the housing and beyond the upper face wherein the flange and vertical section of each guiding arm extend along the smaller second dimension of the lateral sides; and a card receiving space is formed below the top flanges of the guiding arms and above the upper face of the housing defining a front-to-back insertion direction of a card such that the guiding arms are in direct contact with a card during insertion of the card into the receiving space; and a plurality of contacts each having a contact portion which extends beyond the upper face and into the card receiving space.

* * * * *